US005170648A

United States Patent [19]

Jünthner

[11] Patent Number: 5,170,648

[45] Date of Patent: Dec. 15, 1992

[54] YARN FEED DEVICE FOR A KNITTING MACHINE

[75] Inventor: Kurt Jünthner, Bitz, Fed. Rep. of Germany

[73] Assignee: Sipra Patententwicklungs-und Beteiligungsgesellschaft mbH, Albstadt, Fed. Rep. of Germany

[21] Appl. No.: 640,206

[22] Filed: Jan. 11, 1991

[30] Foreign Application Priority Data

Jan. 23, 1990 [DE] Fed. Rep. of Germany ..... 4001761

[51] Int. Cl.[5] ..... D04B 15/54

[52] U.S. Cl. ..... 66/131

[58] Field of Search ..... 66/125 R, 131, 146

[56] References Cited

U.S. PATENT DOCUMENTS 1,782,299 11/1930 Grieve ..... 66/125.2
1,827,660 10/1931 Kent ..... 66/131

FOREIGN PATENT DOCUMENTS 9001082 2/1990 European Pat. Off. ..... 66/131
3421868 12/1985 Fed. Rep. of Germany ..... 66/131
1536664 12/1978 United Kingdom ..... 66/131

*Primary Examiner*—Werner H. Schroeder
*Assistant Examiner*—John J. Calvert
*Attorney, Agent, or Firm*—Michael J. Striker

[57] ABSTRACT

A yarn feed device for circular knitting machines includes a yarn guide (12) by which the yarn (4) is fed to to the knitting implements (3) of the knitting machine from the side. For reliable feed of the yarn the yarn, guide has a downwardly open guide channel (26) with an exit section (29). The channel angle (b) is smaller than the yarn angle (a), at least at the exit section. A passage (14) passing through the yarn guide is provided as a further yarn guide, of which one bounding wall preferably has a yarn threading opening (31) in the form of a slot opening to facilitate threading the yarn.

11 Claims, 3 Drawing Sheets

YARN FEED DEVICE FOR A KNITTING MACHINE

BACKGROUND OF THE INVENTION

This invention relates to a yarn feed device for a knitting machine with a needle bed, with knitting implements movably mounted therein, having hooks for the reception of a yarn, with a yarn guide for side feed of the yarn at a selected yarn angle relative to the knitting implements, and with a cam actuating the knitting implements for guiding the hooks of the knitting implements receiving the yarn on a path having a raising section, a lowering section and an intervening maximum, wherein the yarn guide comprises a guide member provided with a yarn opening for inserting the yarn, and a guide channel for the yarn arranged thereafter in the yarn feed direction and being so arranged that the yarn is fed to the knitting implements from a location beside the path and preceding the maximum, and is caught by the hooks of the knitting implements guided along the lowering section, and wherein the guide channel is arranged downwardly open and at a channel angle relative to the knitting implements and is provided with an entrance section and an exit section facing the raising section.

In a known yarn feed device (DE-PS 3 324 245), a guide member consists of an eye formed from wire, which is anchored on a support stirrup of a yarn guide by a wire coil. The yarn guide has a guide channel with an arcuately curved bottom and an end section with a channel angle which amounts to about 90°, so that the yarn always leaves the guide channel tangentially, regardless of whether it is to be received by all knitting implements or only by knitting implements selected in accordance with the pattern. Because of the eye and the bow-shaped curvature of the guide channel, a comparatively expensive overall device results, which represents a significant cost factor in a high performance machine with a plurality of knitting systems. Moreover the yarn leaves the yarn guide at varying places on the guide channel on account of the arcuate guide channel, according to selection of the knitting implements, which is undesirable on knitting technology grounds.

SUMMARY OF THE INVENTION

The object of the invention is providing a yarn feed device of the kind initially referred to with a yarn guide which can be made comparatively simply and, hence cheaply and which also makes it possible to lay the yarn reliably into the hooks of the knitting implements even in very fast running circular knitting machines.

The object of the invention is achieved by providing in the yarn feed device mentioned above a channel angle which at least at the exit section of the guide channel, is smaller than the yarn angle, and the guide means consists of a passage through the yarn guide.

The invention brings the advantage that the yarn angle can be set optimally while the guide channel can be formed substantially straight, even when a comparatively high arrangement of the yarn guide over the knitting implements is desired. In all arrangements the yarn leaves the yarn guide at the rear end of the guide channel, which can be arranged close on the path described by the hooks of the knitting implements and thus makes possible a reliable, slip-free guidance of the yarn up to the first knitting implement receiving the yarn. Nevertheless a comparatively cheap manufacture of the yarn guide is possible because the guide channel can be made straight and the guide means as a simple bore.

The present invention both as to its construction so to its method of operation, together with additional objects and advantages thereof, will be best understood from the following detailed description of the preferred embodiments when read with reference to the accompanying drawings.

DETAILED DESCRIPTION OF THE PREFERRED EMBODIMENTS

Figure 1:
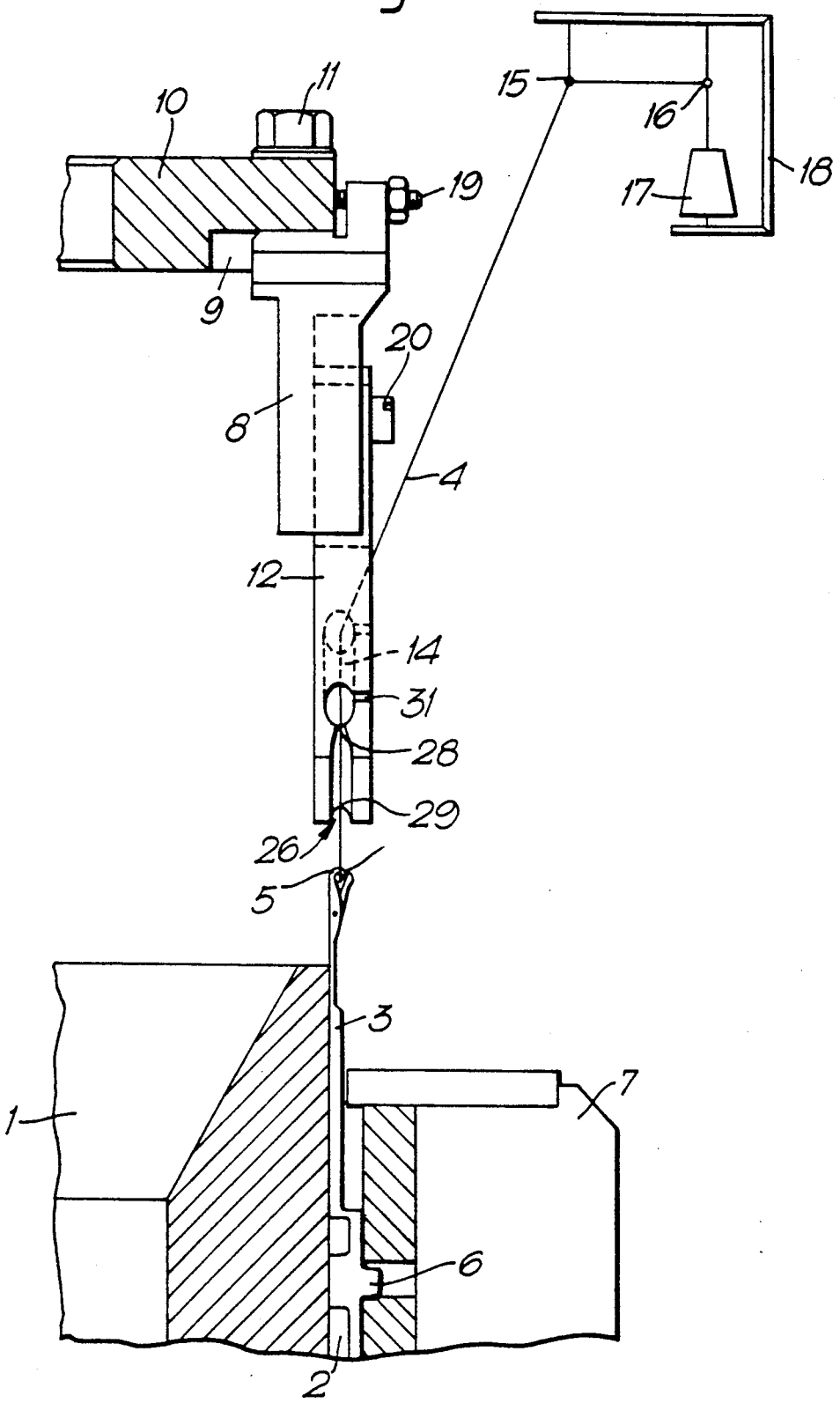
FIG. 1 shows a schematic longitudinal partial cross-sectional view of a circular knitting machine with a yarn guide according to the invention.

The circular knitting machine shown only schematically in FIG. 1 comprises a needle cylinder 1 with needle tricks 2 in which knitting implements 3 with a hook 5 receiving a yarn 4 are mounted for movement up and down. The associated sinkers or the like are not shown. The knitting implements 3 have butts 6, with which is associated a cam 7, by which the knitting implements 3 are raised and lowered in known manner at each knitting system, in order to receive the yarn 4 and to work stitches. A support 8 is fitted in a recess 9 of a frame part 10 of the circular knitting machine and is fixed thereto with a screw 11. On the support 8, there is fixed a yarn guide 12. This has a passage 14 for the yarn 4, which is supplied via eyes 15 and 16 from a supply spool 17, which, like the eyes 15 and 16 is arranged on a further frame part 18 of the circular knitting machine. The yarn guide 12 can be adjusted radially with respect to the needles 3 by means of a set screw 19 screwed into the support 8 and bearing on the frame part 10, onto which screw there is screwed a lock nut. For fixing the yarn guide 12 on the support 8 there serves a clamping screw 20, which extends through a slot in the yarn guide 12, so that this can also be adjusted in height, i.e. parallel to the up and down movement of the knitting implements 3.

The circular knitting machine can be one with rotatable needle cylinder 1 and fixed cam 7 and fixed frame parts 10, 18, or one in which the cam 7 and the frame parts 10, 18 are rotated round a stationary needle cylinder 1.

Circular knitting machines of the kind described and their functioning are generally known and therefore do not need to be further explained.

Figure 2:
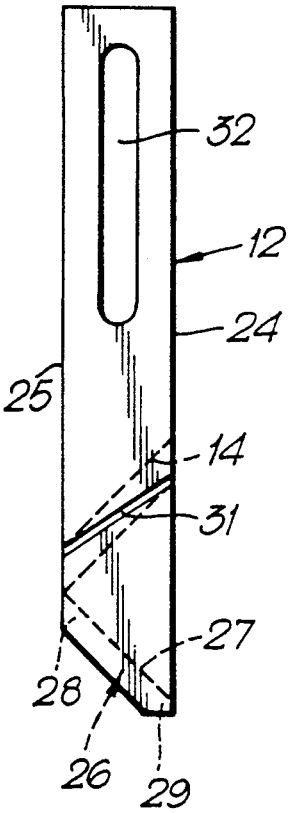
FIG. 2 shows front view of the yarn guide according to FIG. 1.
Figure 3:
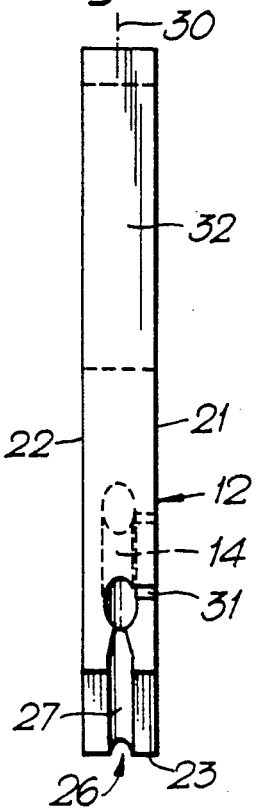
FIG. 3 shows a side view of the yarn guide arrangement according to FIG. 1.
Figure 4:
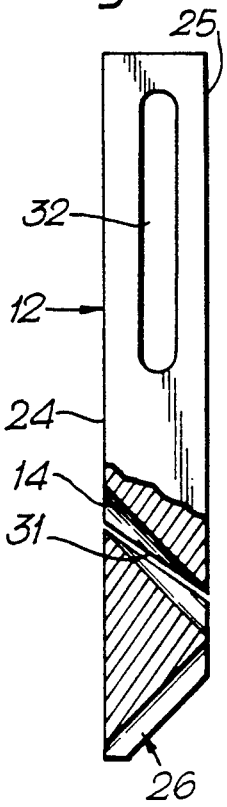
FIG. 4 shows a partially cross-sectional rear view of the yarn guide according to FIG. 1.

The construction according to the invention of the yarn guide 12 is apparent in particular from FIGS. 2 to 4. The yarn guide 12 comprises a substantially flat and rectangular base body, which has a front side 21, a rear side 22, a bottom side 23, a first sidewall 24, a second sidewall 25 and the passage 14. The passage 14 extends over the whole width of the yarn guide 12, inclined downwardly from above, whereby its entrance opening for the yarn in the sidewall 24 lies higher than its exit opening, which is arranged in the sidewall 25 and lower down the base body. The passage 14 is preferably formed as a simple bore and has a straight axis.

On the underside of the base body, there is provided a guide channel 26, which is e.g. of U or V form and has a bottom 27, an entry section 28 and an exit section 29. The guide channel 26 is arranged inclined downwardly from above, whereby the entry section 28 is arranged higher than the exit section 29. Moreover the guide channel 26 is advantageously extended over the whole width of the base body, like the passage 14, however with its entry section 28 adjoining the sidewall 25 on the left in FIG. 2 and its exit section 29 adjoining the sidewall 24 on the right in FIG. 2. Accordingly the guide channel 26 has the opposite inclination to the passage 14, as is clearly apparent from FIGS. 2 and 4. The axes of the passage 14 and the guide channel 26 preferably lie in the same plane, which is the central plane 30 of the base body, according to FIG. 3. The bottom 27 of the guide channel 26 is straight or flat according to a particularly advantageous embodiment of the invention, so that the guide channel 26 can be made in the simplest manner.

The passage 14 is preferably formed as a channel closed on all sides. In order to facilitate threading the yarn in the passage 14, a wall section bounding the passage 14, preferably its front wall, has a yarn threading opening 31 in the form of a slot opening extending over the whole length of the passage 14 and serving for inserting the yarn into the passage 14. The opening 31 preferably runs, as is apparent from FIGS. 2 and 4, not parallel with but at an angle to the axis of the passage 14 or so that, within the passage 14, the yarn makes a comparatively large angle with the slot opening in the usual running direction of the yarn during operation and is thereby prevented from jumping out of the passage 14 inadvertently, but can nevertheless be threaded easily and quickly into the passage 14, and that from the front.

Figure 5:
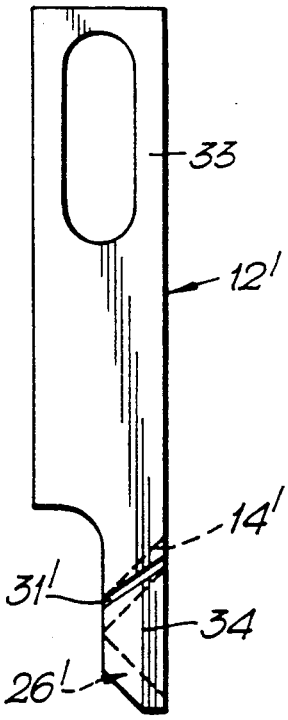
FIG. 5 a front view of an alternative embodiment of the yarn guide according to the invention.

In the upper region of the base body there is provided a mounting opening 32, e.g. a slot. This can, in accordance with FIG. 5, also be formed in a widened fixing part 33 of a yarn guide 12', which advantageously is in one piece with a yarn guide part 34 comprising the passage 14 and the guide channel 26. Such a form of the yarn guide 12' is especially preferred when the spacing of the knitting systems is very small and the yarn guide part 34 must therefore be made correspondingly narrow. In both variants the manufacture of the whole yarn guide 12, 12' is extremely simple.

Figure 6:
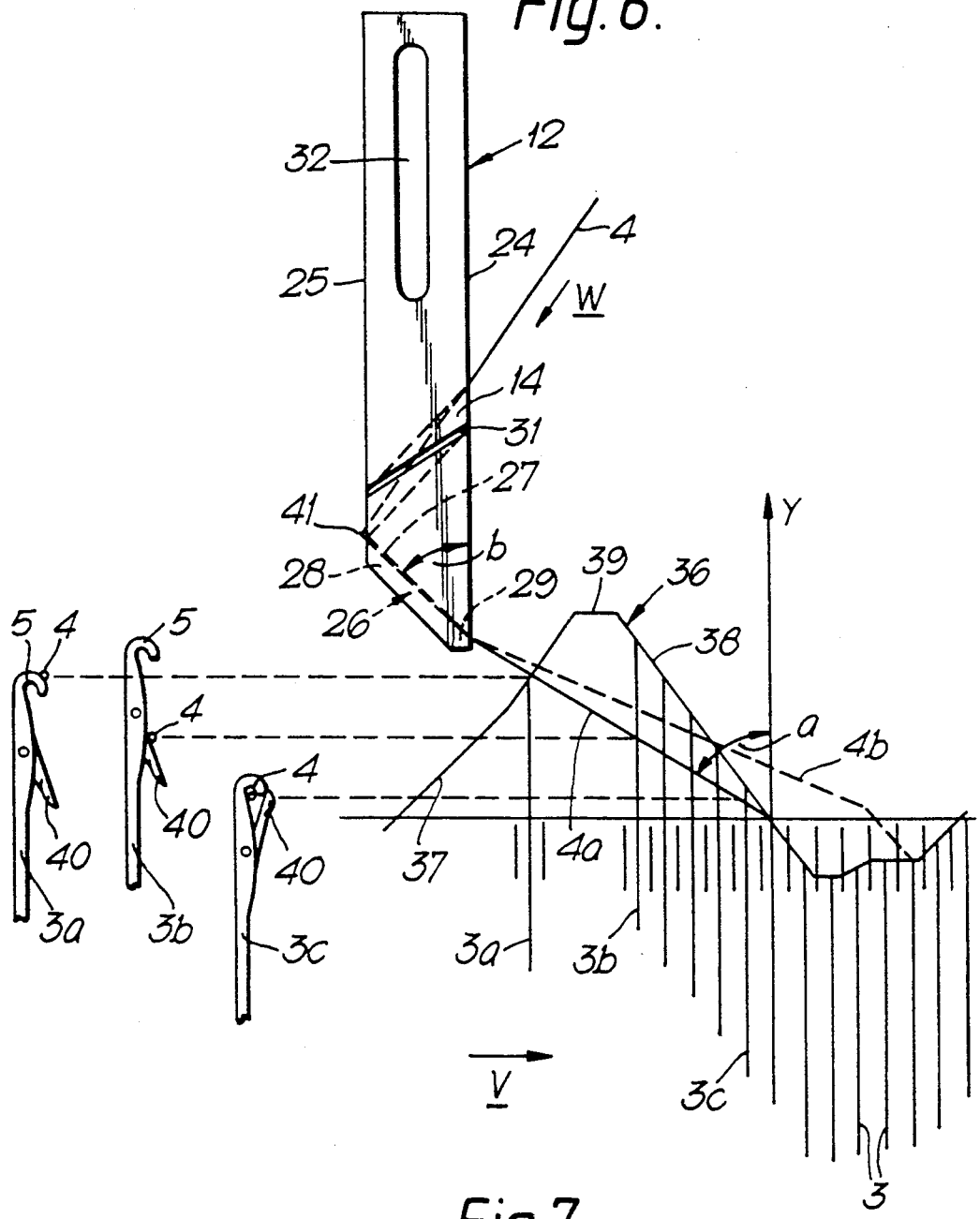
FIG. 6 a schematic front view of the yarn guide and a knitting system of the circular knitting machine according to FIG. 1.
Figure 7:
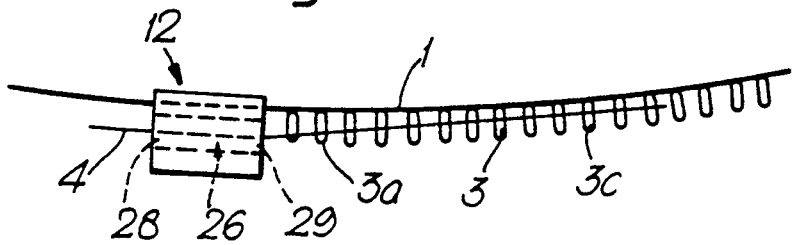
FIG. 7 a schematic plan view of the knitting system according to FIG. 6.

FIGS. 6 and 7 show the yarn guide 12 in use, i.e. after being mounted in the circular knitting machine according to FIG. 1, which has the usual latch needles as knitting implements 3. FIGS. 6 and 7 show only one knitting system of the circular knitting machine, whose other knitting systems can be formed in the same way. Either the yarn guide 12 and the cam 7 (FIG. 1) are held fixed while the knitting implements 3 are transported by the needle bed 1 in the direction of an arrow v, or the needle bed 1 is arranged in a fixed position and the lock 7 is transported opposite to the direction of the arrow v. In both cases the running direction of the yarn 4 is as is indicated in FIG. 6 by an arrow w.

In the region of each knitting system the knitting implements 3, indicated merely by lines, are so raised and lowered by the associated cam 7, perpendicular to the arrow v and parallel to an axis Y, that their hooks, in known manner, follow a path 36, which describes an raising section 37, a following lowering section 38 and an intermediate maximum 39. The yarn guide 12 is arranged with its underside beside the path 36 and so that the exit section 29 of the guide channel 26 is directly alongside the raising section 37 and before the maximum 39, without however touching the rising knitting implements 3. For this it is above all advantageous if the yarn guide 12 is so positioned according to FIG. 7 that its guide channel 26 lies substantially tangential to a needle cylinder 1, along which the knitting implements 3 are arranged in knitting machines or are moved by the needle cylinder. In flat knitting machines, the guide channel 26 is preferably arranged substantially parallel to the plane formed by the axes of the knitting implements 3. Moreover the inclination of the guide channel 26 is preferably of the same direction as the inclination of the lowering section 38 but opposite to the inclination of the raising section 37. For the rest, the relative position of the yarn guide 12 is so selected in known manner that the yarn 4 is laid reliably into the knitting implements 3 and the needle latches are if necessary additionally or alternatively opened or held open (DE-OS 1 585 437, DE-PS 3 324 245), insofar as they are not opened automatically by the stitches located in the hooks 5.

In order to ensure reliable laying in of the yarn even at high knitting speeds, with the associated vibrations of the yarn 4 and the knitting implements 3 and the rapid latch stroke on closing the latches, the yarn 4 should be fed to the knitting implements 3 at a preselected yarn angle a, which is included between the direction in which the knitting implements 3 extend (Y axis in FIG. 6) and that section of yarn 4*a* which lies between the yarn guide 12 and the first knitting implement 3 receiving and working the yarn 4. The size of the yarn angle a arises from various conditions, as is indicated in FIG. 6 with the aid of the schematically shown and full drawn knitting implements 3*a*, 3*b* and 3*c* and their hooks 5 and latches 40. Accordingly the rising knitting implement (e.g. 3*a*) should not immediately touch the yarn 4, which is possible with gentle inclination of the yarn section 4*a* relative to the surface formed by the front sides of the knitting implements 3. On the other hand the yarn section 4*a* must, when the knitting implements 3 are lowered again (e.g. knitting implement 3*b*), be arranged close against the front of the knitting implements 3, so that it is reliably captured by the hooks 5 and retained by these, until the latches 40 have again closed the hooks 5 (e.g. knitting implement 3*c* in FIG. 6). Furthermore the latches 40, which are opened when the knitting implements 3 rise by the stitches located in their hooks 5 and can then spring back, must be prevented from being closed again but are held open by the yarn section 4*a*.

In order to adjust the yarn angle a correctly and then to be able to hold the yarn section 4*a* always in the desired position, the guide channel 26 is provided in the mounted state with a channel angle b at least at its exit section 29 which is smaller than the yarn angle a. This channel angle b is defined by the direction in which the knitting implements 3 extend (Y axis in FIG. 6) and the bottom 27 of the guide channel 26. In practice this channel angle b can e.g. be so preselected or fixedly predetermined that it is constructionally provided between the direction of displacement of the yarn guide 12 parallel to the Y axis made possible by the mounting aperture 32 or the like and the bottom 27 of the guide channel 26 and thus cannot readily be altered after mounting. For this the channel angle b should advantageously be chosen small enough that it is always smaller than the yarn angle a resulting from the adjustment of the yarn guide 12 for all useful settings of the yarn guide 12. If the bottom 27 of the guide channel 26 does not, in contrast to FIGS. 1 to 7, run straight but is gently curved wholly or in part, then these considerations apply to the exit section 29 of the guide channel 26 or its out-run end.

Under the conditions set forth the yarn 4 first passes through the passage 14, emerging at the sidewall 24, is diverted at a location 41 of the same, then passes through the guide channel 26 and finally leaves the yarn guide 12 at the exit section 29. In this the yarn 4 lies close on the bottom 27 of the guide channel 26, especially at the entry and exit sections 28, 29, and is at the same time reliably centred and guided free from oscillations by the guide channel 26 and its sidewall. The still zone thus created for the yarn 4 can be as long as the spacing between the knitting systems allows. It is practically impossible for the yarn 4 to jump out of the guide channel 26 downwards or to the side, since it is deflected both at the entry section 28 and at the exit section 29 and is thus pressed into the guide channel 26. In this the exit section 29 of the guide channel 26 also acts as an anchor point for the yarn, so that the yarn section 4*a* is always held taut and straight between this anchor point and the first knitting implement 3 which works the yarn into a stitch, even with the high lift of the knitting implements, and cannot deviate downwardly or outwardly during the latch stroke and thereby get out of the hooks 5. Moreover the diversions at the location 41 and at the exit section 29 create a certain minimum tension in the yarn section 4*a*, so that this is also fed largely without flutter. The amount of this tension can be selected by altering the angle of diversion at the location 41, e.g. by altering the inclination of the passage 14.

The guide channel 26 centres the yarn 4 and encloses it on three sides. However the guide channel 26 is open on the fourth side, i.e. downwardly, so that the yarn 4 can be laid into it easily and quickly. Moreover, after a break or the like the yarn 4 can easily and quickly be laid into the passage 14 therefor which is "closed" in operation, in that it is threaded in from the front through the yarn threading slot opening 31. On account of the described yarn path the passage 14 can be given a comparatively large cross-section, which is good for the passage of possible slubs and for keeping clean.

Since the channel angle b is smaller than the yarn angle a, the described yarn path alters only insignificantly when not all but only selected knitting implements are to receive the yarn 4, insofar as the floats thereby resulting are not too long. As the broken line 4*b* in FIG. 6 indicates, the yarn angle a in any case becomes larger, but not smaller, on the occurrence of floats, so that the guiding of the yarn in the yarn guide 12 does not change and the anchor point at its exit always stays the same. Accordingly floats are possible over a plurality, e.g. five knitting implements 3 without difficulty, without the yarn section 4*b* getting into over strong oscillation. Since the anchor point at the exit of the yarn guide 12 can moreover be arranged in very close proximity to the raising section 37, with precise positioning of the same the yarn can be reliably prevented from getting behind the knitting implements during the ascent thereof (e.g. knitting implement 3*a* in FIG. 6), even on the occurrence of slight oscillations.

The invention is not limited to the described embodiments, which can be modified in many ways, insofar as the desired yarn guiding is not thereby affected. In particular the various edges and surfaces with which the yarn 4 comes into contact can for example be rounded, in order to avoid too high a yarn tension and/or damage to the yarn 4. Moreover it is not necessary for the passage 14 and the guide channel 26 in the yarn guide part 34 or in the yarn guide 12 to be arranged one above the other, since the yarn 4 can also be held reliably on the bottom of the guide channel 26 when this is offset e.g. to the side relative to the passage 14 or when the passage 14 has the same or a similar inclination to the guide channel 26. Moreover the guide channel 26, 26' can have a V-shaped or U-shaped cross-section, in contrast to FIGS. 1 and 3.

While the invention has been illustrated and described as embodied in a yarn feed device for a knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set fourth in the appended claims.

1. A yarn feed device for a knitting machine having a needle bed, a plurality of knitting implements movably mounted in the bed and having yarn receiving hooks guided, upon movement of the implements, along a path having a raising section, a lowering section, and an intervening maximum section, said yarn feed device having a yarn guide member for a lateral feeding of a yarn at a predetermined yarn angle to the knitting implements, said yarn guide member comprising a guide passage extending through said yarn guide member and having a threading opening for inserting the yarn into said guide passage, and a yarn guide channel arranged after said guide passage in a yarn feed direction for feeding the yarn to the knitting implements from a location beside the path and preceding the maximum section of the path so that the yarn is caught by the yarn receiving hooks when said hooks are guided along the lowering section of the path, said yarn guide channel being open downwardly, having an entrance section and an exit section facing the raising section of the path, and extending, at least at said exit section, at a channel angle relative to a vertical axis of the knitting implements which channel angle is smaller than the yarn angle.

2. A yarn feed device as set forth in claim 1, wherein said passage has a straight axis.

3. A yarn feed device as set forth in claim 1, wherein said threading opening is a slot extending at an angle to the passage axis.

4. A yarn feed device as set forth in claim 1, wherein said guide means further includes a support element formed integral with said guide member.

5. A yarn feed device for a knitting machine having a needle bed, a plurality of knitting implements movably mounted in the bed and having yarn receiving hooks guided, upon movement of the implements, along a path having a raising section, a lowering section, and an intervening maximum section, said yarn feed device comprising guide means for side feeding a yarn at a predetermined yarn angle to the knitting implements, said guide means including a guide member having a guide passage for receiving the yarn, a threading opening for inserting the yarn into said guide passage, and a yarn guide channel arranged after said opening in a yarn feed direction for feeding the yarn to the knitting implements from a location beside the path and preceding the maximum section of the path so that the yarn is caught by the yarn receiving hooks when they are guided along the lowering section of the path, said yarn guide channel being opened downwardly, having an entrance section and an exit section facing the raising section of the path, and extending, at least at said exit section, at a channel angle relative to a vertical axis of the knitting implements which is smaller than the yarn angle, said passage being located above said guide channel, and said passage and said guide channel extending along an entire width of said guide member.

6. A yarn feed device for a knitting machine having a needle bed, a plurality of knitting implements movably mounted in the bed and having yarn receiving hooks guided, upon movement of the implements, along a path having a raising section, a lowering section, and an intervening maximum section, said yarn feed device comprising guide means for side feeding a yarn at a predetermined yarn angle to the knitting implements, said guide means including a guide member having a guide passage for receiving the yarn, a threading opening for inserting the yarn into said guide passage, and a yarn guide channel arranged after said opening in a yarn feed direction for feeding the yarn to the knitting implements from a location beside the path and preceding the maximum section of the path so that the yarn is caught by the yarn receiving hooks when they are guided along the lowering section of the path, said yarn guide channel being opened downwardly, having an entrance section and an exit section facing the raising section of the path, and extending, at least at said exit section, at a channel angle relative to a vertical axis of the knitting implements which is smaller than the yarn angle, said guide channel having a straight bottom.

7. A yarn feed device for a knitting machine having a needle bed, a plurality of knitting implements movable mounted in the bed and having yarn receiving hooks guided, upon movement of the implements, along a path having a raising section, a lowering section, and an intervening maximum section, said yarn feed device comprising guide means for side feeding a yarn at a predetermined yarn angle to the knitting implements, said guide means including a guide member having a guide passage for receiving the yarn, a threading opening for inserting the yarn into said guide passage, and a yarn guide channel arranged after said opening in a yarn feed direction for feeding the yarn to the knitting implements from a location beside the path and preceding the maximum section of the path so that the yarn is caught by the yarn receiving hooks when they are guided along the lowering section of the path, said yarn guide channel being opened downwardly, having an entrance section and an exit section facing the raising section of the path, and extending, at least at said exit section, at a channel angle relative to a vertical axis of the knitting implements which is smaller than the yarn angle, said passage and said guide channel being inclined in opposite directions.

8. A yarn feed device for a knitting machine having a needle bed, a plurality of knitting implements movably mounted in the bed and having yarn receiving hooks guided, upon movement of the implements, along a path having a raising section, a lowering section, and an intervening maximum section, said yarn feed device comprising guide means for side feeding a yarn at a predetermined yarn angle to the knitting implements, said guide means including a guide member having a guide passage for receiving the yarn, a threading opening for inserting the yarn into said guide passage, and a yarn guide channel arranged after said opening in a yarn feed direction for feeding the yarn to the knitting implements from a location beside the path and preceding the maximum section of the path so that the yarn is caught by the yarn receiving hooks when they are guided along the lowering section of the path, said yarn guide channel being opened downwardly, having an entrance section and an exit section facing the raising section of the path, and extending, at least at said exit section, at a channel angle relative to a vertical axis of the knitting implements which is smaller than the yarn angle, said guide member having a sidewall, said threading opening and said exit section of said guide channel lying in said sidewall.

9. A yarn feed device as set forth in claim 8, wherein said sidewall lies laterally in front of the maximum section of the path, adjacent to the raising section of the path, and faces both.

10. A yarn feed device for a knitting machine having a needle bed, a plurality of knitting implements movably mounted in the bed and having yarn receiving hooks guided, upon movement of the implements, along a path having a raising section, a lowering section, and an intervening maximum section, said yarn feed device comprising guide means for side feeding a yarn at a predetermined yarn angle to the knitting implements, said guide means including a guide member having a guide passage for receiving the yarn, a threading opening for inserting the yarn into said guide passage, and a yarn guide channel arranged after said opening in a yarn feed direction for feeding the yarn to the knitting implements from a location beside the path and preceding the maximum section of the path so that the yarn is caught by the yarn receiving hooks when they are guided along the lowering section of the path, said yarn guide channel being opened downwardly, having an entrance section and an exit section facing the raising section of the path, and extending, at least at said exit section, at a channel angle relative to a vertical axis of the knitting implements which is smaller than the yarn angle, the raising section of the path and said guide channel being inclined in opposite directions.

11. A yarn feed device for a knitting machine having a needle bed, a plurality of knitting implements movably mounted in the bed and having yarn receiving hooks guided, upon movement of the implements, along a path having a raising section, a lowering section, and an intervening maximum section, said yarn feed device comprising guide means for side feeding a yarn at a predetermined yarn angle to the knitting implements, said guide means including a guide member having a guide passage for receiving the yarn, a threading opening for inserting the yarn into said guide passage, and a yarn guide channel arranged after said opening in a yarn feed direction for feeding the yarn to the knitting implements from a location beside the path and preceding the maximum section of the path so that the yarn is caught by the yarn receiving hooks when they are guided along the lowering section of the path, said yarn guide channel being opened downwardly, having an entrance section and an exit section facing the raising section of the path, and extending, at least at said exit section, at a channel angle relative to a vertical axis of the knitting implements which is smaller than the yarn angle, the lowering section of the path and said guide channel being inclined in a same direction.

* * * * *